US006453485B2

(12) United States Patent
Bullock

(10) Patent No.: US 6,453,485 B2
(45) Date of Patent: Sep. 24, 2002

(54) PROTECTIVE DEVICE FOR A BATHTUB

(76) Inventor: Charles Bullock, 348 Covered Bridge Rd., King of Prussia, PA (US) 19406

( * ) Notice: Subject to any disclaimer, the term of this patent is extended or adjusted under 35 U.S.C. 154(b) by 0 days.

(21) Appl. No.: 09/779,122

(22) Filed: Feb. 8, 2001

Related U.S. Application Data

(63) Continuation-in-part of application No. 09/476,890, filed on Jan. 3, 2000, now abandoned.

(51) Int. Cl.[7] ..... A47K 3/02
(52) U.S. Cl. ..... 4/580; 4/DIG. 18
(58) Field of Search ..... 4/580–583, 657, 4/DIG. 18; 5/413 AM, 655.3, 710

(56) References Cited

U.S. PATENT DOCUMENTS 2,264,672 A * 12/1941 Levine ..... 4/580
2,604,641 A * 7/1952 Reed ..... 5/710
5,839,132 A * 11/1998 Rooney ..... 4/583

* cited by examiner

*Primary Examiner*—Charles E. Phillips
(74) *Attorney, Agent, or Firm*—LaMorte & Associates, P.C.

(57) ABSTRACT

A padded mat device that is used to protect harmful contact with hard surfaces, such as bathtubs edges. The padded mat device contains a top surface and a bottom surface that are joined together along a common peripheral edge. The interior of the padded mat device is filled either with air or with some padding material. The interior of the padded mat device is partially segmented. The top surface and bottom surface of the padded mat are periodically joined at seams along a plurality of parallel lines that extend between opposite edges of the padded mat device. The points where the top surface and the bottom surface join create depressions on the exterior of the padded mat device. Consequently, the lines of the seams become natural folding points where the padded mat device can be folded into different configurations. A plurality of suction cups extend from the bottom surface of the padded mat device. The suction cups adhere to a hard surface being padded.

13 Claims, 3 Drawing Sheets

PROTECTIVE DEVICE FOR A BATHTUB

RELATED APPLICATIONS

This application is a Continuation-In-Part of U.S. patent application Ser. No. 09/476,890, entitled, Protective Device For Protecting The Edge Of A Bathtub, which was filed on Jan. 3, 2000 now abandoned.

BACKGROUND OF THE INVENTION

1. Field of the Invention

The present invention relates to safety devices that are used to pad the edges of hard objects so that a person is not severely injured should they fall and strike that object. More particularly, the present invention relates to safety devices that are designed to protect the edge of a bathtub, thereby reducing injuries to people who slip and fall when bathing in the bathtub.

2. Description of the Prior Art

Every year many people slip and fall in their bathtubs. Many injuries and death occur do to these falls. The reasons people so commonly fall in their bathtubs is obvious. Bathtubs typically have hard, smooth bottoms. The bottom of the bathtub becomes very slick when covered with soapy water. As a person moves around in the bathtub, that person's foot can easily slip along the surface of the bathtub and cause that person to fall. Bathtubs are hard. Furthermore, bathtubs are surrounded by hard tiled surfaces and metal plumbing fixtures. Consequently, should a person lose their footing and fall, that person will probably land against a hard surface, thereby increasing the chances of severe injury.

Injuries due to falling in a bathtub are greatest among children and senior citizens. This is because muscle coordination and balance in these age groups are diminished. Severe injuries caused by falling in the bathtub are commonplace among senior citizens due to size, weight and bone fragility.

One of the most dangerous surfaces to fall upon in a bathtub is the edge of the bathtub. The edge of the bathtub projects upwardly and is relatively narrow. The edge of the bathtub therefore contains clearly defined edges that can cause severe injury when struck. Furthermore, whenever a person enters or leaves a bathtub, that person must step over the edge of the bathtub. To step over the edge of the bathtub, a person must lift one foot over the edge. This leaves only the other foot supporting the weight of the person. Commonly, it is during this process that a person slips and falls. Since the person is stepping over the edge of the bathtub when they fall, they commonly strike the hard edge of the bathtub.

In the prior art, there have been several devices designed to cover the edge of a bathtub and make it a less hazardous obstacle. Such devices include bathtub liners and edge covers. Bathtub liners are exemplified by U.S. Pat. No. 5,839,132 to Rooney, entitled Inflatable Bathtub Liner. Bathtub edge covers are exemplified by U.S. Pat. No. 5,771,506 to Joiner, entitled, Protection Apparatus.

A problem associated with both prior art tub liners and bathtub edge covers is that they only fit some bathtubs. Bathtubs have been in common use for the last two hundred years. During that period, a wide variety of different bathtub shapes and designs have been used. Each bathtub design has a bathtub edge of a different height, width, length and contour. Bathtub liners, such as was illustrated in the cited Rooney patent, show liners that must match the shape of the bathtub. If the liner does not match the bathtub, the liner will buckle and will itself become a tripping hazard. Bathtub edge protectors, such as was shown in the cited Joiner patent, contain internal hinges. If the hinges in the edge protector do not correspond to the edges of the side of the bathtub, the edge protector does not lay properly on the edge of the bathtub and may continually fall off.

A need therefore exists for a bathtub edge protector and liner that can easily configure to any shaped bathtub, thereby reducing the risk of injury to a person falling in the bathtub. This need is met by the present invention as described and claimed below.

SUMMARY OF THE INVENTION

The present invention is a padded mat device that is used to protect against harmful contact with hard surfaces, such as bathtubs edges. The padded mat device contains a top surface and a bottom surface that are joined together along a common peripheral edge. The interior of the padded mat device is filled either with air or with some padding material, such as foam or elastomeric gel. The interior of the padded mat device is partially segmented. The top surface and bottom surface of the padded mat are periodically joined at seams along a plurality of parallel lines that extend between opposite edges of the padded mat device. The points where the top surface and the bottom surface join create seams on the exterior of the padded mat device. Since the seams extend along straight lines, the seams become natural folding points where the padded mat device can be folded into different configurations.

A plurality of suction cups extend from the bottom surface of the padded mat device. The suction cups adhere to a hard surface being padded, such as a bathtub. If the hard surface being padded is not planar, the padding device conforms to the surface being padded by folding along the lines of the seams. A padded surface is therefore provided that conforms to the contours of the original hard surface and is firmly affixed to the original hard surface.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE INVENTION

Although the present invention device can be used to protect most any smooth surface, such as a child's pool, a sink edge or the like, the present invention is particularly well suited for use in protecting the edge of a bathtub. Accordingly, by way of example, the present invention system will be described in an application where the device is used to protect the edge of a bathtub.

Figure 1:
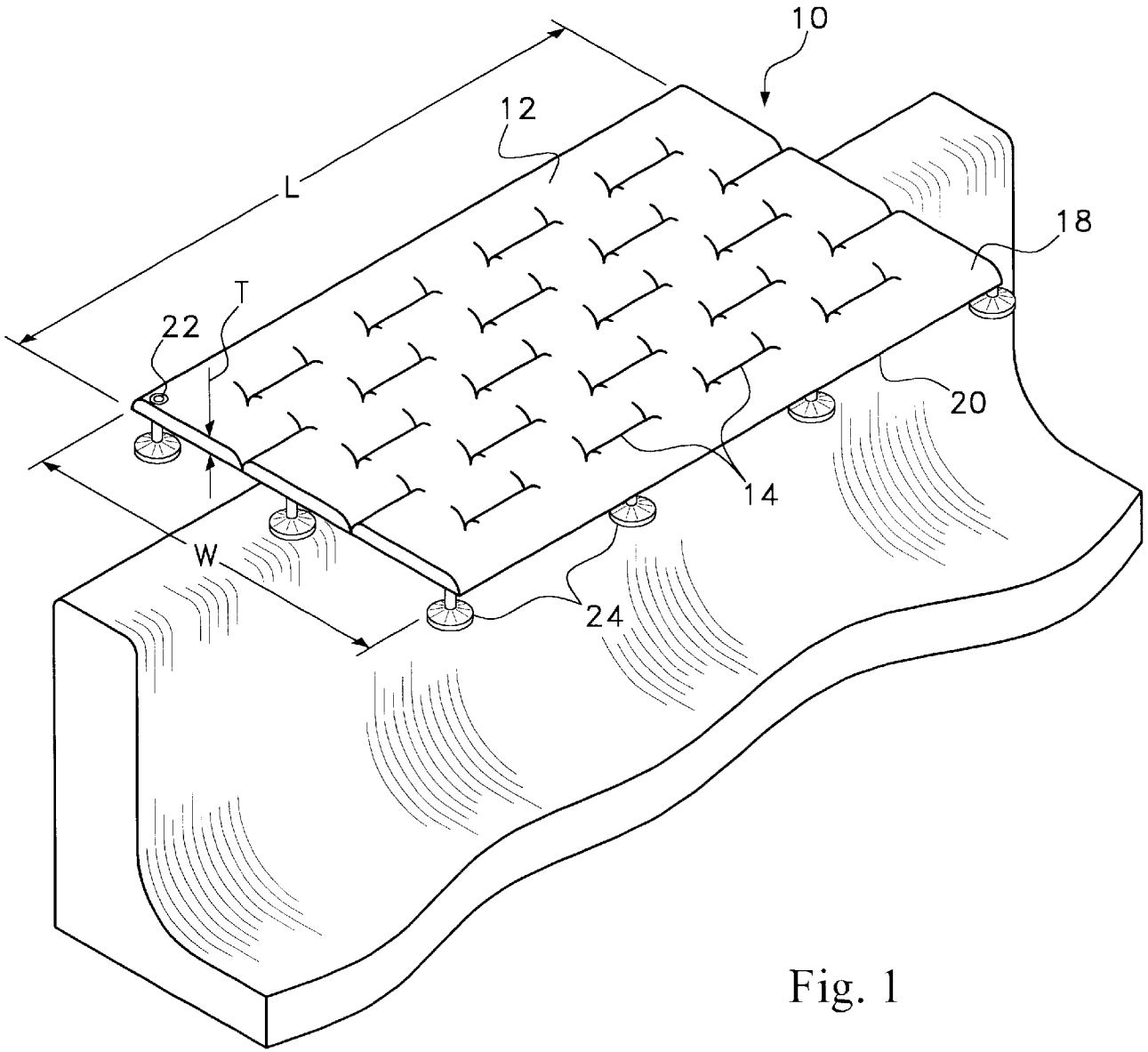
FIG. 1 is perspective view of an exemplary embodiment of a padded mat device shown in conjunction with a segment of a bathtub.

Referring to FIG. 1, the present invention device 10 is shown. The present invention device 10 includes a padded mat 12 having a length L of between one foot and four feet and a width W of between eight inches and four feet. The padded mat 12 has a quilted structure, wherein the padded mat defines series of parallel seams 14. The linear seams 14 are parallel to the long side edges of the padded mat 12. At the areas of the linear seams 14, the top surface 18 and the bottom surface 20 of the padded mat 12 connect. The thickness of the padded mat 12 at these points is therefore equal to the sum of the thickness of the top surface 18 and bottom surface 20.

The top surface 18 and the bottom surface 20 of the padded mat 12 are also joined along a common peripheral edge. The material comprising the top surface 18 and the bottom surface 20 of the padded mat is preferably a water impervious material such as vinyl or some other plastic.

The padded mat 12 defines an enclosed interior region within the common peripheral edge. Within this enclosed region, the top surface 18 and the bottom surface 20 are periodically joined along linear seams 14. The linear seams 14 are disposed along a plurality of parallel rows. Each of the parallel rows contains a plurality of linear seams 14 that are symmetrically spaced apart. As such, in the same row, the top surface 18 and the bottom surface 20 are joined together along the linear seams 14 and are separated in the spaces between the linear seams 14. The padded mat 12 has an overall length L. The combined lengths of all the linear seams 14 in a single row add up to be between 30% to 70% of that overall length L. In the preferred embodiment, the length of all the linear seams 14 in a single row add up to be approximately 50% of the overall length L of the padded mat 12.

Each of the rows that contain the linear seams 14 are parallel. However, the positions of the linear seams 14 in adjacent rows are not the same. Rather, the linear seam 14 in adjacent rows are staggered. As such, the positions of the linear seams 14 in every other row is aligned.

The area within the padded mat 12 can be filled with any soft material, such as cloth padding, foam or an elastomeric gel. However, in the preferred embodiment, the padded mat 12 is inflatable and is filled with air. When fully filled or inflated, the padded mat 12 preferably has a thickness T of between one half inch and four inches. A fill plug 22 is provided to enable a person to selectively inflate and deflate the padded mat 12 as desired.

A plurality of suction cups 24 are attached to the bottom surface 20 of the padded mat 12. The suction cups 24 are disposed along the peripheral edge of the bottom surface 20 of the padded mat 12. In larger sized padded mats, suction cups may also be positioned on interior points on the bottom surface of the padded mat. The suction cups 24 are preferably aligned along lines that do not correspond to either the columns or rows of the depressions on the padded mat 12.

Figure 2:
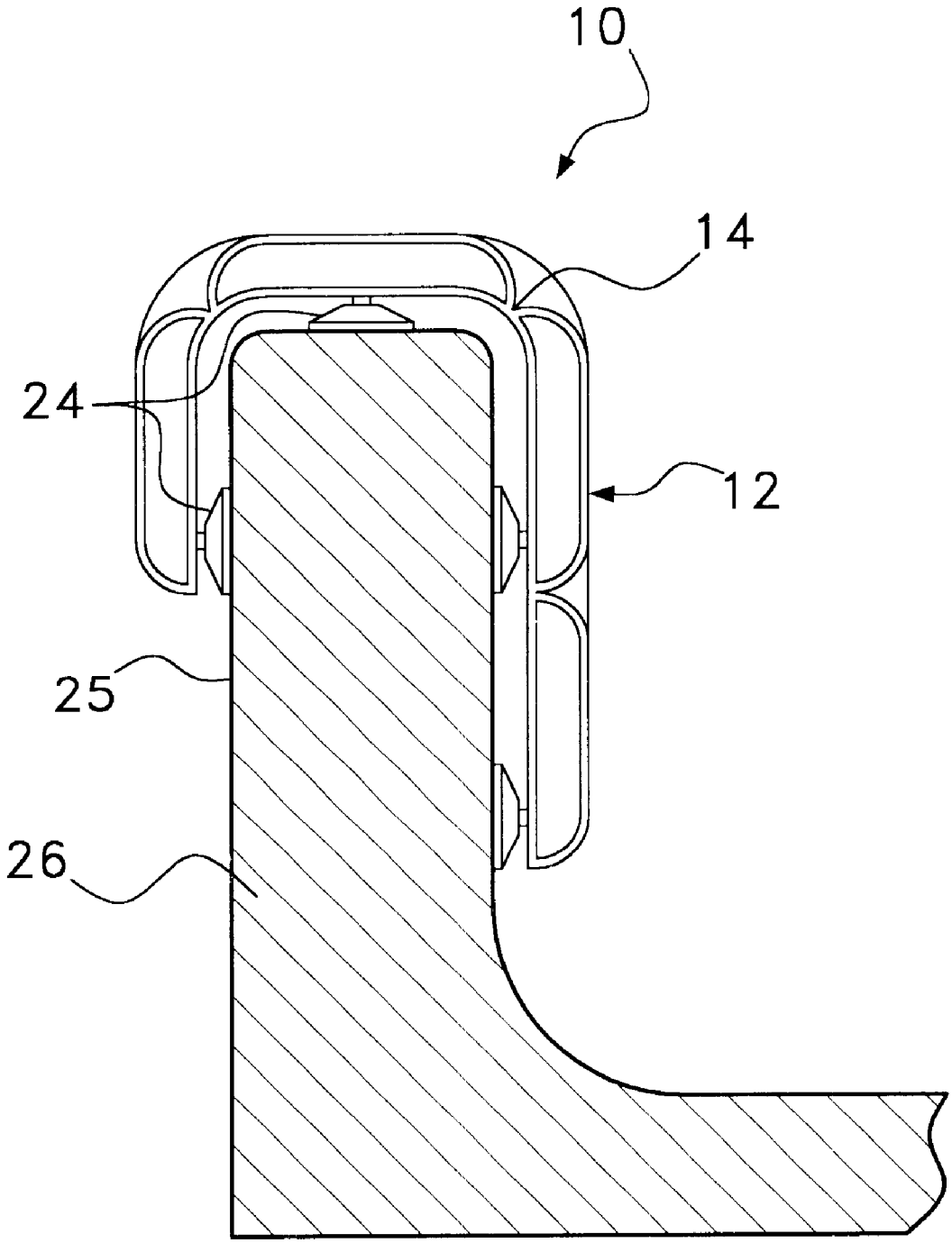
FIG. 2 is a cross-sectional view of the embodiment of FIG. 1 shown attached to the edge of a bathtub.

The suction cups 24 are capable of adhering to any smooth surface. Referring to FIG. 2, it can be seen that to install the present invention device 10, the padded mat 12 is placed over the surface to be protected. In FIG. 2, the surface to be protected is a bathtub edge 26. To attach the padded mat 12, the suction cups 24 along one side of the padded mat 12 are adhered to the exterior surface 25 of the bathtub edge 24. The padded mat 12 is then folded over the bathtub edge 26 toward the interior of the bathtub. The linear seams 14 in the padded mat 12 act as natural hinges. Accordingly, the padded mat 12 easily folds along any line that corresponds to a row of linear seams 14 in the padded mat 12. Since the linear seams 14 are spaced in parallel rows, the padded mat 12 easily folds over any bathtub edge 26 regardless of its width or contoured shape. Furthermore, since the linear seams 12 are not continuous along any row, when the padded pat is folded along that row the fold line is not devoid of padding. Rather, in between the linear seams 14 in any row, padding will exist that provides protection along the fold line.

After the padded mat 12 folds over the bathtub edge 26, the suction cups 24 on the opposite edge of the padded mat 12 adhere to the interior of the bathtub. The padded mat 12 is therefore firmly held in place on either side of the bathtub edge 26. As a result, the padded mat 12 will not fall from the bathtub edge 26, even when repeatedly contacted by movement of the person in the shower and the shower curtain.

In the embodiment of FIG. 2, the padded mat 12 covers the top surface of the bathtub edge 26 and the corners of the bathtub edge 26. These are the surfaces most likely to be contacted should a person slip and fall in the bathtub. Accordingly, if a person were to slip and fall in the bathtub, they would contact the material of the padded mat 12 rather than the hard surface of the bathtub edge 26. This greatly reduces the potential for severe injury.

Figure 3:
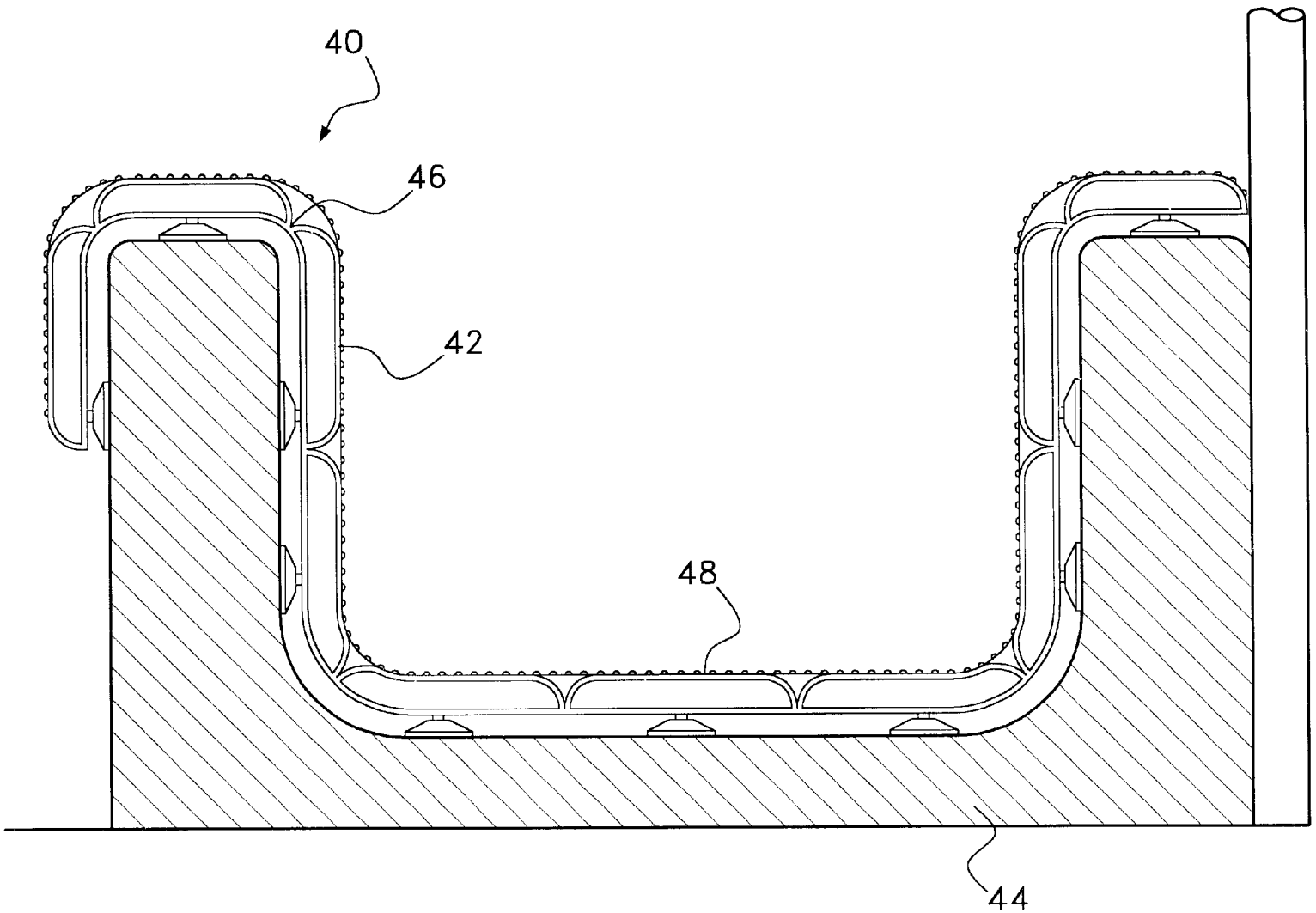
FIG. 3 is a cross-sectional view of an alternate embodiment of the present invention padded mat device shown attached to a bathtub.

Referring now to FIG. 3, it can be seen that the present invention device 40 can be made large enough to cover the full interior of a bathtub 44. In this embodiment, the padded mat 42 has a width wide enough to cover the bottom of the bathtub 44, the walls of the bathtub 44 and the side edges of the bathtub 44. With a padded mat 42 of such a length, suction cups will be disposed across the entire width and length of the padded mat 42, so as to secure the padded mat 42 to the bathtub 44 at multiple points. The padded mat 42 attaches to one exterior surface of the bathtub 44. The padded mat 42 is then extended over the edge of the bathtub 44, across the bottom of the bathtub 44 and up over the opposite edge of the bathtub 44. Each time the padded mat 42 is bent to conform to the bathtub 44, the padded mat 42 bends along one of the rows of linear seams 46. This prevents the padded mat 42 from buckling and inaccurately conforming to the bathtub 44. Once attached to a bathtub 44 in such a manner, the padded mat 42 covers all surfaces of the bathtub 44 that may be contacted should a person slip and fall. Accordingly, the potential of serious injury is greatly reduced.

In the embodiment of FIG. 3, a person stands on the padded mat 42 when showering. To prevent slippage, the top surface 48 of the padded mat 42 may be either textured or coated so as to make the top surface 48 of the padded mat less slippery to a person standing on that surface. The texturing or coating can be molded into the material of the padded mat 42 or added afterwards.

It will be understood that the specifics of the present invention described above illustrate only exemplary embodiments of the present invention. A person skilled in the art can therefore make numerous alterations and modifications to the shown embodiments utilizing functionally equivalent components to those shown and described. All such modifications are intended to be included within the scope of the present invention as defined by the appended claims.

What is claimed is:

1. A padded mat device for covering the edge of a bathtub over which a person steps to enter the bathtub, said device comprising:

a top surface having a periphery defined by a first set of parallel side edges and a second set of parallel side edges;

a bottom surface having a periphery defined by a first set of parallel side edges and a second set of parallel side edges, wherein said periphery of said top surface is joined to said periphery of said bottom surface, thereby defining an enclosed interior region within said side edges, said top surface and said bottom surface being periodically joined in direct abutment to each other along linear seams between said side edges, wherein said linear seams are disposed along a plurality of parallel rows, and each of said parallel rows contains a plurality of linear seams that are symmetrically spaced apart so that said top surface and said bottom surface are joined along each linear seam line in a parallel row and are separated between each linear seam line in that same parallel row, and wherein said linear seams in adjacent parallel rows are not aligned laterally; and a plurality of suction cups extending from said bottom surface proximate said peripheral edge.

2. The device according to claim 1, wherein said parallel rows have a predetermined length and said linear seams on each of said parallel rows added up to a length that is between 30% and 60% of said predetermined length.

3. The device according to claim 1, wherein said top surface and said bottom surface are air impervious and said enclosed interior region is filled with air.

4. The device according to claim 3, further including a fill port for adding and removing air from said enclosed interior region.

5. The device according to claim 1, wherein said top surface and said bottom surface are water impervious.

6. The device according to claim 1, wherein said enclosed interior region is filled with a padding material selected from a group consisting of cloth padding, foam and elastomeric gel.

7. A safety device for protecting the edge of a bathtub, comprising:

an inflatable pad having four side edges, a length between one foot and four feet, a width between eight inches and four feet and a thickness of between one half inch and four inches, wherein said inflatable pad has a top surface and a bottom surface that are periodically joined together in direct abutment along linear seams between said side edges, wherein said linear seams are disposed along a plurality of parallel rows, and each of said parallel rows contains a plurality of linear seams that are symmetrically spaced apart so that said top surface and said bottom surface are joined along each linear seam line in a parallel row and are separated between each linear seam line in that same parallel row, and wherein said linear seams in adjacent parallel rows are not aligned laterally; and a plurality of suction cups extending from said bottom surface.

8. The device according to claim 7, wherein said parallel rows have a predetermined length and said linear seams on each of said parallel rows added up to a length that is between 30% and 60% of said predetermined length.

9. The device according to claim 7, wherein said suction cups are disposed on said bottom surface proximate said four side edges.

10. The device according to claim 7, wherein said plurality of linear seams are parallel to two of said four side edges of said inflatable pad.

11. The device according to claim 7, wherein said top surface is textured to increase its coefficient of friction.

12. The device according to claim 7, wherein said top surface is coated with a non-slip material.

13. A method of padding the edge of a bathtub over which a person steps to enter the bathtub, said method comprising the steps of:

providing a padded mat having a top surface, a bottom surface joined to said top surface along common side edges, said top surface and said bottom surface being periodically joined in direct abutment to each other along linear seams between said side edges, wherein said linear seams are disposed along a plurality of parallel rows, and each of said parallel rows contains a plurality of linear seams that are symmetrically spaced apart so that said top surface and said bottom surface are joined along each linear seam in a parallel row and are separated between each linear seam in that same parallel row, and wherein said linear seams in adjacent parallel rows are not aligned laterally;

placing said padded mat over the edge of the bathtub to be padded;

conforming the padded mat to the edge of the bathtub to be padded by bending said padded mat along said linear seams; and adhering the padded mat to the bathtub with suction cups to retain the padded mat in position over the edge of the bathtub to be padded.

* * * * *